United States Patent [19]

Sulser

[11] Patent Number: 4,635,301

[45] Date of Patent: Jan. 13, 1987

[54] UPPER BODY GARMENT CONSTRUCTION

[75] Inventor: Henry Sulser, Weite, Switzerland

[73] Assignee: Almopa Anstalt, Eschen, Liechtenstein

[21] Appl. No.: 604,697

[22] Filed: Apr. 27, 1984

[30] Foreign Application Priority Data

Apr. 27, 1983 [CH] Switzerland ..... 02258/83

[51] Int. Cl.[4] ..... A41B 1/08; A41D 27/00

[52] U.S. Cl. ..... 2/69; 2/105; 2/114

[58] Field of Search ..... 2/69, 87, 105, 114, 2/115, 243 B

[56] References Cited

U.S. PATENT DOCUMENTS 2,798,225 7/1957 Jacobson ..... 2/115
3,720,957 3/1973 Patience ..... 2/114
4,473,908 10/1984 Knecht ..... 2/114 X

FOREIGN PATENT DOCUMENTS 2232071 1/1974 Fed. Rep. of Germany .
1027631 5/1953 France ..... 2/105
1352132 5/1974 United Kingdom ..... 2/114

*Primary Examiner*—Werner H. Schroeder
*Assistant Examiner*—J. Olds
*Attorney, Agent, or Firm*—Blum Kaplan Friedman Silberman & Beran

[57] ABSTRACT

An upper body garment including a front body section, a back body section and two sleeves extending from the upper portion of the front and back section for covering the front, back, shoulders and arms of a wearer formed of two pieces of fabric and a single closing seam is provided. The upper fabric member includes two outwardly extending sleeve and upper arm sections with a central neck cutout and the lower fabric member includes a central lower back section with two outwardly extending front body sections. Both upper and lower fabric members are formed with curved cutout regions for forming arm and shoulder regions of the garment. The entire garment is formed by two seams joining the cooperating contoured cutout regions and the closing seam.

15 Claims, 1 Drawing Figure

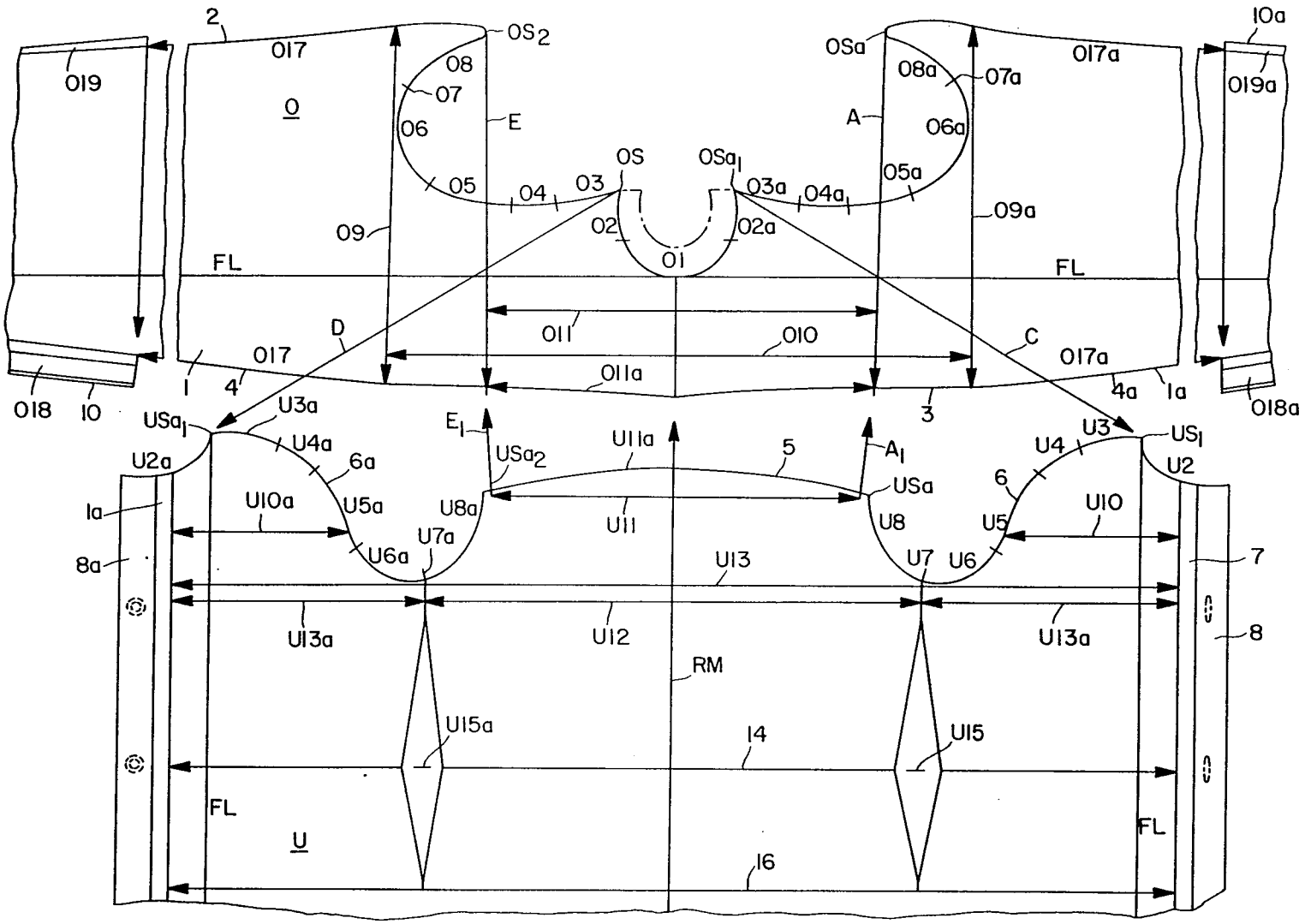
10a
019a
018a
017a
07a
09a
08a
06a
05a
05a
A
04a
03a
02a
05a1
01
05
03
02
04
05
E
05a2
08
07
06
09
017
O
2
FL
017a
C
3
1a
4a
010
011
011a
D
017
4
1
019
10
018
7
8
U5
U2
U3
U4
6
U5
U6
U7
U8
U5a
A1
5
U11a
U11
U5a2
E1
U8a
U7a
U6a
6a
U5a
U4a
U3a
U10a
U2a
1a
8a
U10
U13a
U15
U13
RM
U12
U15a
U13a
U
14
16
FL

UPPER BODY GARMENT CONSTRUCTION

BACKGROUND OF THE INVENTION

The invention involves an upper body garment with a front part, a back part and sleeves, a method for manufacturing such a garment as well as pieces of fabric cut for such an upper body garment, and a pattern for cutting a similar upper body garment.

The upper body garments known consist of several parts and their manufacture may require, for example, more than nine operations not including, for example, the application of waist widths (e.g. CH-Pat. No. 533 428). A rational production method of known upper body garments such as dress shirts requires, above all, double-faced closing seams connected to closing seams underneath the sleeves which right away will require two operations from sleeve insert to completing the trunk part. For example, a model of execution according to the technique mentioned above will require four cut pieces and nine sewing operations. Together with the cuff slits, one arrives at six pieces and eleven operations. This will lead not only to a large number of cuts and, accordingly, a considerable use of fabric, but the dress shirt will also show an equally large number of seams. For all that, the respective cuts and shapes of the known dress shirt cannot be used for all types of cloth. It is certainly difficult to apply cuts for elastic cloth to other types of cloth and to obtain a proper fit with the required widths.

A known dress shirt, equally from the aforementioned CH-Pat. No. 533 428, consists of two parts, with a one-piece front part and a shoulder part, cut without any seams so that the back part and the sleeves are seamlessly attached to it. This makes it possible to avoid a closed sling from the sleeve seam to the upper end near the shoulders. However, a similar dress shirt can only be made with elastic shift fabric, because otherwise the adjustment to the body shape necessary for a good fit cannot be achieved. The shirt consisting of the aforementioned pieces does not, however, offer any possibility for closing. Consequently, it has to be equipped with two other pieces after cutting. Besides, notwithstanding the fact that there are only two pieces, there will be a need for six operations, i.e. the front part and the sleeves have to be sewn on the left and the right, the back part and front part have to be sewn on the left and the right, and the sleeves have to be sewn closed on the left and the right. In addition, there is the handling time.

As a result, a similar shirt and its method of manufacture do not fulfill all the desires of the wearer or the manufacturer.

The purpose of the present invention is therefore the creation of an upper body garment of the type mentioned at the beginning, as well as of a method for manufacturing such a garment, cut pieces of fabric and a pattern for such a garment, so that the upper body garment can be made and used with a minimum number of parts and seams, and be applicable to many types of garments besides dress shirts.

SUMMARY OF THE INVENTION

Generally speaking, in accordance with the invention, an improved upper body garment including a front body section, back body section and two sleeves extending from the upper portion of the front and back sections for covering the front, back, shoulders and arms of the wearer is provided. The upper body garment is formed from only two pieces of garment fabric eliminating the necessity for slide seams. The garment includes a single closing seam which runs uninterrupted from the end of one sleeve across the back section to the end of the other sleeve. The two fabric pieces are each formed with two cooperating contoured curves for forming shoulder and arm regions of the garment which are seamed.

The invention is also directed to the method for forming the garment, the cut fabric pieces and a pattern for cutting the fabric pieces.

Accordingly, it is an object of the invention to provide an improved upper body garment.

Another object of the invention is to provide an improved upper body garment formed from only two pieces of fabric having a single closing seam which runs uninterrupted from the end of one sleeve across the back section to the end of the other sleeve.

It is a further object of the invention to provide a method for forming an improved upper body garment.

It is another object of the invention to provide cut fabric pieces for forming improved upper body garments.

Still another object of the invention is to provide patterns for cutting garment pieces for forming improved upper body garments.

Still other objects and advantages of the invention will in part be obvious and will in part be apparent from the specification.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawing, in which:

The sole FIGURE includes an upper fabric member and a lower fabric member for forming an improved upper body garment in accordance with the invention.

DESCRIPTION OF THE PREFERRED EMBODIMENTS

In order to meet this purpose, the upper body garment of the type mentioned in the beginning has a single closing seam which runs uninterrupted over the back part from one sleeve end to the other sleeve end.

On account of the single closing seam and the closing seam path according to the invention, the side seams now necessary in every upper body garment become superfluous. Not only will it now be possible to create new methods of manufacture, there is also the advantage that the upper body garment can consist of two parts. Every upper body garment can be made, regardless of the type of fabric. Above all, the upper body garment according to the invention permits greater wearing comfort adapted to the body.

Advantageous models of execution of the garment according to the invention can be achieved with the characteristics described herein.

Thanks to the new closing seam path of the upper body garment according to the invention, the latter can consist of an upper part and a lower part. The upper part will preferably include both sleeves, the upper arm area sections and the upper front part and back part sections. Both sleeves, the upper arm area sections and the upper front part and back part sections are preferably attached to one another without seams, i.e. so as to form one piece. The lower part includes preferably the lower back part section and the front parts which, preferably, are also attached to one another without seams, so that preferably the lower part too consists of one piece.

Preferably, the upper and lower part of the sleeves are incorporated in the front and back part sections of the upper part, from the upper arm area sections onward, so that a new cutting line path originates and the new closing seam will only require a single operation. This closing seam path constitutes a deviation from the methods of manufacture known at present.

In the garment according to the invention, the upper part and the lower part are preferably attached to one another with only three seams, i.e. two connecting seams and a single closing seam.

The upper body garment according to the invention requires a new construction in which preferably two parts will yield an elegant fit, whereby curved lines in the cutting will be advantageously adapted to the shape of the body. The lower part, preferably consisting of one piece, will contain accurately adapted counter-curves, which are connected with seams to the curves of the upper part.

The upper part may have contoured curves along the edge bordering on the front part, starting on both sides of the neck cutout and running to an arm opening in the back; the lower part will have corresponding counter-curves. The curves and counter-curves correspond to, or contain, for example, a shaped shoulder part, while the front parts of the lower part include, for example, part of the neck cutout. A shoulder shaping seam of the garment according to the invention will preferably be part of the connecting seam between the upper part and the lower part and will run, in a rounded form, underneath the part of the wearer corresponding to the arm joint, to the armpit or shoulder hole of an arm opening of the back part. In each case, a connecting seam may run alongside the curves and countercurves. The third seam, i.e. the closing seam, will run alongside the sleeve edges and the edge of the back part, between the upper part and the lower part. In one model of execution, the one-piece lower part may contain darts between the front part and the back part.

An upper body garment with a front part, a back part and sleeves can be made according to the invention, if an upper part including both sleeves, upper arm area sections and an upper back part, is attached to a lower part which includes the lower back and front parts.

For this purpose, both sleeves and the upper back part section will be cut as part of the upper arm area section and be seamlessly attached to it, so that the upper part is preferably of one piece. Similarly, the front parts are preferably cut as part of the back part section and seamlessly attached to it, so that the lower part is preferably of one piece. Preferably, the one-piece upper part mentioned above is then attached to the one-piece lower part, also mentioned above. For this purpose, preferably only three seams and also only three operations wil be needed. We may already conclude from this that the upper body garment according to the invention presents a remarkable advantage as far as its manufacture is concerned. This is preferably achieved by the fact that only one upper and one lower part are to be cut, i.e. two main parts. Advantageous models of execution of the method of manufacture of the garment can be achieved with the characteristics described herein.

In a first operation the upper and lower parts can be sewn, in an advantageous manner, along the curved edges of the parts, which run from the one side of the neck cutout of a shaped shoulder part and along an arm opening in the back, up to the edge of the back part. In a second operation one can then sew, in accordance with the curves and along the edges, between the other side of the neck cutout and the edge of the back part. In a third operation, the upper part can be sewn to the lower part by means of the closing seam, which runs alongside one sleeve edge, over the back part edge and along the other sleeve edge.

Preferably, the first and second operations will be started each time at the neck cutout, while the third operation will be started at the sleeve adjacent to the first completed seam. In addition, it is possible to insert darts on both sides of the transition from the back part to the respective front parts. The neck cutout can be fitted with a collar and the front parts with devices for closing, while the free ends of the sleeves may be equipped with cuffs.

The upper body garment according to the invention can be used in all ready-to-wear clothes, e.g. cloths for women, girls, men and boys. Fabrics can be chosen at random, e.g., woven or knitted fabrics or non-woven fabrics, e.g., of natural or synthetic fibers or, e.g., also leather or synthetic leather. The upper body garment may assume different forms, e.g., dress shirt, blouse, pajamas, training gear, sportswear, e.g. ski jacket or jeans jacket, rain gear or professional clothes. In rain gear in particular, the small number of seams is an advantage.

The invention permits, in a properly arranged workshop, considerable savings in work from the cutting to the finishing stage. Indeed, preferably only three operations will be necessary which, dependent upon the arrangements in the workshop, will each take, for example, 1.5 minutes, i.e., 4.5 minutes in total. If one takes into account, for example in addition to these three operations, three periods for handling of 1 minute each, i.e., a total of 3 minutes, one will preferably arrive at a total manufacturing time for the garment of 7.5 minutes. Because the invention also allows the remaining manufacturing steps to be shortened, the total manufacturing time can be considerably reduced. With a proper design and arrangement of the workshop, it is possible to save up to 10 minutes on the total manufacturing time for each upper body garment. This shows clearly the advantage of the present invention with regard to known manufacturing methods for upper body garments.

In an advantageous manner according to the invention, we can create furthermore a piece of fabric cut for a garment with a front part, a back part and sleeves, which, as one upper part, includes the sleeves, the upper arm area sections and an upper back part section. Preferably, the piece of fabric cut according to the invention will include the sleeves and the upper back part section, cut to form one piece with the upper arm area sections and seamlessly attached to the latter, so that the upper part consists of one piece. Other preferred models of execution of the piece of fabric can be achieved by means of the characteristics of claims 19 to 21. The upper part will preferably contain a cutout on its one long side, with contoured curved edges starting on both sides of the neck cutout. The edges will preferably run alongside a shoulder part and an arm opening in the back, up to the respective sleeve edges. The other long side of the upper part which includes the sleeves may, in the cut piece of fabric, have one edge free of cutouts. The edges of the upper part, which is cut to form one piece with the sleeves, will preferably correspond to the edges of the other part of the garment, when they are put together and sewn.

A cut piece of fabric which serves as the lower part of an upper body garment with a front part, a back part and sleeves, includes a lower back part section with front parts. The front parts are preferably cut to form one piece with the lower part section and are seamlessly attached to it, so that a one-piece lower part can be created. Advantageous models of execution can be achieved by means of the characteristics of claims 23 to 26. This piece of fabric cut as lower part can be advantageously attached to the other aforementioned piece of fabric cut according to the invention and serving as upper part. The cut piece of fabric serving as lower part will present in an advantageous manner, for example on the side of each front part to be connected to the other parts of the garment, a cutout with a contoured curved edge starting from a neck cutout. This edge runs alongside a shaped shoulder part and an arm opening in the back, up to a back part edge. The back part edge will preferably lie between the cutouts, and the neck part cutouts will preferably lie on the free outside border of the front parts. The curved edges of the front parts and the back part edge will preferably correspond to the edges of other parts of the garment, when they are put together and sewn.

When cutting an upper body garment consisting of front parts, a back part and sleeves, one will start, in an advantageous manner, with a pattern. This pattern contains a first part which includes the sleeves, the upper arm area sections and the upper back part section of the upper part of the garment. The pattern contains a second part which includes the back part and the front parts of the lower part of the garment. In a preferred model of execution, the part corresponding to the sleeves, the upper arm area sections and the upper back part section of the upper part will, on the one hand, consist of one piece while, on the other hand, the part corresponding to the lower back section and the front parts of the lower part will also consist of one piece. Other advantageous models of execution of the pattern according to the invention can be achieved by means of the characteristics of claims 28 to 33. The pattern according to the invention ensures that a garment can be made consisting of two parts which are connected to one another by three seams only.

The invention is further explained hereafter, by means of a model of execution shown in a drawing which outlines a pattern for cutting an upper body garment with a front part, a back part and sleeves. The individual parts of the pattern correspond to cut pieces of fabric.

There is a part O which corresponds to the upper part of the upper body garment, and a part U which corresponds to the lower part of the upper body garment; they are also referred to hereafter by "upper part O" and "lower part U".

The upper part O and the lower part U contain the following individual areas and pieces, as listed:

Upper part O

O1 Cutout for the neck in the back
**O2,O2*a*** Cutouts for the neck in the front part
**O3,O3*a*** Shoulder shapes moved to the front part
**O4,O4*a*** Curvature for the arm joint
**O5,O5*a*** Upper arm curvature
**O6,O6*a*** Front arm height shape
**O7,O7*a*** Upper and lower sleeve intersections
**O8,O8*a*** Lower sleeve curvature
**O9,O9*a*** Upper arm area
O10 Arm joint height - back part
O11 Upper back part section
**O11*a*** Backclosing border
**O17,O17*a*** Sleeve closing borders
**O18,O18*a*** Attached folding cuffs
**O19,O19*a*** Sleeve slit hem
**O20,O20*a*** Lower sleeve cut edge Lower part U

**U2,U2*a*** Neck cutout, front parts
**U3,U3*a*** Shoulder counter-curves
**U4,U4*a*** Counter-curve to the arm joint curvature
**U5,U5*a*** Counter-curve to the upper sleeve curvature
**U6,U6*a*** Front armpit cutout
**U7,U7*a*** Side line path
**U8,U8*a*** Lower sleeve counter-curves
U10 Chest section
U11 Lower back part section
**U11*a*** Back closing border
U12 Half upper area
U13 Total upper area
**U13*a*** ¼ upper area
U14 Waist area, variable
**U15,U15*a*** Waist darts
U16 Hip area The upper part O consists of one piece and includes the upper arm area sections **O9,O9*a* with the attached sleeves 1,1*a* and the back part section O11, so that the sleeves 1,1*a* and the back part section O11 are seamlessly attached to the upper arm area sections O9,O9*a*. One long side 2 of the upper part O has a cutout which represents the neck cutout in the back O1, and the neck cutouts in the front O2,O2*a*. To the above, the elements O3 to O8, respectively O3*a* to O8*a*, of the list presented earlier, are attached on both sides along contoured curves. The other long side 3 of the upper part O, which includes the lower sleeve borders 4,4*a* corresponding to the closing seam O17, respectively O17*a***, does not have cutouts.

The sleeves **1,1*a*, shownhere in a shortened version, have folding cuffs O18,O18*a*. The lower part U consists of a back part 5 and the attached front parts 6,6*a*, so that the back part 5 forms a seamless unit with the front parts 6,6*a* and the whole consists of one piece. Thus, the lower part U is a onepiece item. On the side where the lower part U will be attached to the upper part O of the upper body garment, it has an edge—corresponding to the closing seam in the back U11*a*—to which will be connected, on both sides of an imaginary center line RM, the parts or elements U8 to U3, respectively U8 to U3*a*, mentioned in the list above, along contoured counter-curves corresponding to the curves of the upper part O. The shoulder counter-curves U3, U3*a* will connect on both sides with the neck cutouts U2,U2*a* of the front parts, along corresponding contoured curves. If the curves O3 to O8, respectively O3*a* to O8*a*, are designed to agree with the corresponding counter-curves U3 to U8, respectively U3*a* to U8*a***, it will be possible, when these curves are accurately calculated, to make an upper body garment consisting of two pieces, which fits the shape of the body.

U10 shows, for example, the area of the chest section of each front part 6, 6*a*. Between the front parts 6,6*a* and the back part 5, we see darts U15,U15*a*. The front parts 6,6*a* have overlapping sections 7,7*a* and a doubled-back area 8,8*a*, to which closing devices can be attached for the lower part. The lines FL in the upper part O and in the lower part U indicate the direction of the thread of the warp, for example in case cloth is used. This will govern the direction of the cutting and is of fundamental importance, because the direction of the thread agrees exactly with the path of the cutting line. This means that the thread direction, i.e. the orientation of the warp, and therefore also the weft, of the one-piece upper part O and the one-piece lower part U can be exactly adapted to one another, so that no constricting seams will occur and produce folds, something which cannot be avoided in the cutting and seam processes known at present.

To produce the cut pieces of fabric for the upper part O, one cuts along the edges O17, O11*a* and O17*a*, as well as along the edges O1 to O8, respectively O1*a* to O8*a*, and the front edges 9,9*a* of the sleeves. The upper part is now ready. To cut a piece of fabric for the lower part U, one cuts along the edges which correspond to the parts or elements, U2*a* to U8*a*, U11*a* and U8 to U2 indicated above. Furthermore, one cuts of course along the corresponding edges of the doubled-back area and along the fourth edge—not shown here—of the lower part U.

When we think of the aforementioned parts of the pattern as cut pieces of fabric, the upper part O and the lower part U can be sewn to one another as follows:

As a start, a connecting seam is sewn during a first operation, along the cuts, also referred to as borders, O8*a* to O3*a* and U8 to U3. For this purpose, the intersection or corner point OS*a*, at the transition of the lower sleeve curvature O8*a* and the sleeve closing border of the upper part O will be brought, or placed, together according to arrow A, with the intersection or corner point US*a* at the transition of the lower sleeve counter-curve U8 and the back closing border U11*a* of the lower part U, according to arrow $A_1$. After these borders have been sewn, the intersection or transition points $OSa_1$ of the uper part O, and $US_1$ of the lower part U, will coincide according to arrow C.

In a second operation, the intersection or transition point OS, between the neck cutout of the front part O2 and the shoulder shape O3 of the upper part O, is made to coincide with the intersection or transition point $USa_1$, of the transition between the neck cutout of the front part U2*a* and the shoulder counter-curve U3*a*, according to the arrow D; subsequently, a connecting seam is sewn along the borders O3 to O8 and U3*a* to U8*a*. After this seam has been completed, intersection points $OS_2$ of the upper part O, and $USa_2$ of the lower part U will coincide in accordance with the arrows E and $E_1$.

In a third operation, one sews, starting at the sleeve end part 10, along the upper and lower sleeve closing borders O17, the back closing borders O11*a*, U11*a* and the upper and lower sleeve closing borders O17*a*, all the way to the sleeve end part 10*a*. Consequently, there will be a continuous closing seam along the aforementioned borders from the sleeve end part 10, via the back parts O11 and U11, up to the sleeve end part 10*a*. Dependent upon, for example, the appropriate equipment, one may also start the first operation by, for example, superimposing the transition points $OSa_1$ and $US_1$ according to arrow C, and execute the first connecting seam starting at the shaped shoulder part O3*a* or the shoulder counter-curve U3.

The upper body garment is closed by means of the closing seam and is thus completed. As mentioned earlier, it is obvious that the neck cutout O1, O2, O2*a*, U2, U2*a*, can be equipped with a collar, and the doubled-back section with commonly used closing devices such as buttons and button holes, or zippers. Similarly, the ends of the sleeves may be equipped in the traditional manner with cuffs.

The pattern represented by the drawing shows preferably a basic form for the upper and lower parts. By means of the upper and lower parts made according to the invention, the shoulder shaping seam can be moved to collar-bone height in the front part. Thanks to the curves in the upper and the lower parts, the shoulder shaping seam can run, in a curved path, underneath the arm joint of the wearer up to the armpit and from there into the arm opening in the back which, as a result, may be moved quite far over into the back part. Thanks to this path of the cutting line, we will obtain an upper part according to the inventin which will preferably present a fully new sleeve shape, with which it forms a whole. As a result we obtain, for example with regard to the sleeve borders, preferably at knuckle height of the wearer, the necessary border widths as well as a simple manner of manufacture according to the invention, because the sleeve borders are preferably incorporated in the sleeve shape and they can be finished with or without cuffs. For example, potential customers may be wide on top in relation to their waist size, and have large hips. With simple operations, the waist width can be made narrower or wider according to the size of the wearer.

With the piece of fabric cut according to the invention, or with the pattern according to the invention one obtains, for example during manufacturing, thanks to one operation, a simple closing seam which runs from the sleeve end over the back part. Thanks to this cutting path it will be possible for example, to complete the garment in a single, third operation, after the first two operations described earlier have been performed.

The three seams will preferably provide a harmonious result and also yield, for example, great freedom of movement for the wearer of the garment made according to the invention. There are, for example, no constricting connecting seams at the shoulders, arm joints and armpits. A fine fit and a proper shape adapted to the body can be obtained with the garment thanks to, for example, exact counter-curves in the upper and lower parts, as well as, for example, distribution according to thread direction,lengthwise, crosswise or diagonal, which is preferably adjusted to one another in both parts. The pattern according to the invention permits, for example, the cutting of a ready-made garment consisting of two parts whereby in the cutting, for example, one no longer has to make adjustments for stripes or checks because, for example, the thread directions can be accurately adapted to one another when joining the upper and lower parts. This permits many models of execution, for example, with a flat back, in contrasting colors, i.e. the upper part has a different color from the lower part, with a back with two symmetrical seams in the waist, which may be cut over a considerable length, or similar.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An upper body garment including a front body section, a back body section and two sleeves extending from the upper portion of the front and back sections for overcoming the front, back, shoulders and arms of a wearer, comprising one single closing seam (O17, O11*a*, U11*a*, O17*a*) which extends continuously from the outward end (10) of one sleeve across the upper portion of the back section of the garment (O11, U11) to the outward end (10*a*) of the second sleeve without interruption.

2. The upper body garment of claim 1, including:

an upper member (O) having a front edge and a back edge formed with two outwardly extending sleeves and upper arm sections (1 and O9, 1*a* and O9*a*) with a central upper back section (O11) between said sleeve and upper arm sections, a lower member (U) having a top edge and a bottom edge formed with two outwardly extending front body sections (6, 6*a*) and a central lower back section (U11) between said front body sections; and said upper member and lower member joined by said closing seam.

3. The upper body garment of claim 2, wherein the sleevs and upper arm sections are integrally formed with the upper back section of the upper member from a first single piece of fabric and the front body sections and the lower back body section of the lower member are integrally formed from a second single piece of fabric.

4. The upper body garment of claim 3, wherein the front edge of the upper member is formed with a central inwardly curved neck cutout (O1, O2, O2*a*) and first contoured curve (O3 to O8) for defining a shoulder and armhole cutout on one side of the neck cutout and a second contoured curve (O3*a* to O8*a*) on the other side of the neck cutout for defining the second shoulder and armhole cutout of the garment and said first and second contoured curves extending from the neck cutout to the front edge of the upper member and the lower member is formed with a cooperating first countercurve (U3 to U8) and a cooperating second countercurve (U3 to U8) for defining the second shoulder and armhole cutout said countercurve of the lower member cooperating with the first and second contoured curves of the upper member.

5. The upper body garment of claim 4, wherein the upper member and lower member are attached at a first seam along the first contoured curve and the cooperating first countercurve, a second seam along the second contoured curve of the upper member and the cooperating second countercurve and a third seam being the closing seam joining the front edge and back edge of the upper member at the sleeve sections and the back edge of the upper member to the top edge of the lower member.

6. The upper body garment of claim 4, wherein the first and second contoured curves in the upper member and the cooperating countercurves in the lower member define a shaped shoulder section (O3, O3*a*, U3, U3*a*) and the top edge of the front section of the lower member (U) define the front body portion of the neck cutout (O1, O2, O2*a*, U2, U2*a*).

7. The upper body garment of claim 5, wherein the first and second contoured curves in the upper member and the cooperating first and second countercurves in the lower member define a shaped shoulder section (O3, O3*a*, U3, U3*a*) which forms a portion of the first and second seams between the upper member and the lower member and curved continuously to the top edge of the lower member to define armpits of the garment (O6, O6*a*, U6, U6*a*).

8. The upper body garment of claim 2, wherein the lower member does not include any side seams between the front sections and the lower back section.

9. The upper body garment of claim 2, wherein the lower member further includes darts (U15, U15*a*) between the front sections and the connecting back section.

10. A method for fabricating an upper body garment including a front body section, a back body section and two sleeves and upper arm sections extending from the upper portion of the front and back sections for covering the front, back, shoulders and arms of a wearer, comprising:

forming an upper body member having a front edge and a back edge with two outwardly extending sleeve and upper arm sections with a central upper back section between the two sleeve and upper arm sections, the front edge formed with a central neck cutout and a contoured shoulder and arm countercurve on each side of the neck cutout;

forming a lower member having a central lower back section with a top edge and bottom edge and two front body sections extending outwardly from the lower back section, the top edge formed with two inwardly countercurved sections for cooperating with the contoured curves of the top member; and joining the upper member and lower member by joining the contoured curves of the upper member to the cooperating countercurves of the lower member and by joining the front edge to the back edge of one sleeve section, the back edge of the upper member to the top edge of the lower member and the front edge to the back edge of the other sleeve by a single closing seam extending continuously from the outward edge of said one sleeve to the outward end of the second sleeve along the front and back edges thereof.

11. The method of claim 10, wherein the upper member and lower member are joined by stitching.

12. The method of claim 10, including the step of forming the upper member with a central neck cutout and joining the upper member to the lower member beginning at the neck cutout and along the contoured curves and cooperating countercurves.

13. The method of claim 10, further including the step of forming darts in the lower member at the transition between the back section and front sections.

14. The method of claim 12, further including the step of joining a collar to the neck cutout.

15. The method of claim 10, further including mounting closing devices on a doubled-back area of the front sections.

* * * * *